United States Patent [19]

Schäublin

[11] Patent Number: 4,721,542

[45] Date of Patent: Jan. 26, 1988

[54] APPARATUS FOR BONDING SHEET-LIKE TEXTILE ARTICLES

[75] Inventor: Hans J. Schäublin, Riehen, Switzerland

[73] Assignee: Herbert Kannegiesser GmbH & Co., Vlotho, Fed. Rep. of Germany

[21] Appl. No.: 824,397

[22] Filed: Jan. 23, 1986

[30] Foreign Application Priority Data

Jan. 31, 1985 [DE] Fed. Rep. of Germany ..... 3503164

[51] Int. Cl.[4] ..... B32B 31/18

[52] U.S. Cl. ..... 156/353; 156/510; 156/517; 156/552

[58] Field of Search ..... 156/353, 354, 355, 510, 156/516, 517, 519, 521, DIG. 19, DIG. 28, DIG. 33, DIG. 45, 538, 540, 522, 552, 555, 556, 583.1, 583.9; 242/186, 188, 191

[56] References Cited

U.S. PATENT DOCUMENTS

| | | | |
|---|---|---|---|
| 2,672,251 | 3/1954 | Schwartz et al. | 156/517 |
| 2,690,104 | 9/1954 | Schwartz et al. | 156/540 |
| 3,079,825 | 3/1963 | Biben | 156/DIG. 33 |
| 3,175,938 | 3/1965 | Moberg | 156/521 |
| 3,753,836 | 8/1973 | Buckholz | 156/521 |
| 3,929,552 | 12/1975 | Bettenhausen et al. | 156/521 |
| 4,360,398 | 11/1982 | Sabee | 156/268 |
| 4,497,420 | 2/1985 | Stelcher et al. | 156/DIG. 33 |
| 4,560,431 | 12/1985 | Inselmann | 156/555 |
| 4,608,114 | 8/1986 | Nakao | 156/555 |
| 4,623,422 | 11/1986 | Lindquist | 156/555 |
| 4,645,559 | 2/1987 | Kaiser et al. | 156/583.1 |

FOREIGN PATENT DOCUMENTS

| | | |
|---|---|---|
| 0036989 | 10/1981 | European Pat. Off. . |
| 1330954 | 9/1973 | United Kingdom . |
| 2054519 | 2/1981 | United Kingdom . |
| 2064480 | 6/1981 | United Kingdom . |
| 2090579 | 7/1982 | United Kingdom . |
| 2137961 | 10/1984 | United Kingdom . |

*Primary Examiner*—Caleb Weston

*Attorney, Agent, or Firm*—Sughrue, Mion, Zinn, Macpeak & Seas

[57] ABSTRACT

The apparatus for bonding sheet-like textile articles has, in the region of a feed station, an interlining dispenser for supporting rolled-up strip-shaped interlining material (21) and for cutting it to a fixed dimension. At the output of the interlining dispenser there is a pivotable flap (32) which, when the front end of the interlining material is pulled, is thereby pivoted and actuates a switch (34). An electronic control (45) thereupon excites an electromagnet (36) which actuates a knife (cutting edge 50) for cutting off the band (21). The electronics then activate a stepping motor (26) which, via drive devices (43, 44, 27, 24, 25), draws the band (21) off from a supply roll (18) by a dimension predetermined by a digital preselector switch (37) and thereby, as seen from the knife, pushes an interlining blank (19) of predetermined length over the flap (32).

16 Claims, 9 Drawing Figures

37
45
59
69
57
60
61
26
62
63
58
56
54
55
36
34

APPARATUS FOR BONDING SHEET-LIKE TEXTILE ARTICLES

DESCRIPTION

The invention relates to an apparatus and process for bonding sheet-like textile articles.

A process and an apparatus of the type mentioned above are known from the older German patent applications No. P 34 05 505.3 corresponding to pending U.S. patent application Ser. No. 697,365, which was filed Feb. 1, 1985 and which is expressly incorporated herein by reference. This known apparatus, which is particularly suitable for the economical bonding of textile sheet-like structures of varying size in the form of outer-fabric and interlining blanks, has a holding, device for outer-fabric blanks on the tending or operator side in front of the laying-on surface of the feed station. For the interlining blanks, an interlining holder (storage surface) is provided above the laying-on surface in a region of the latter remote from the tending side. When relatively large quantities (bundles) of narrow, especially strip-shaped interlining blanks are stored on the interlining holder, the bundles or blanks repeatedly fall apart, and this has an adverse effect on the attendant's work method and handiing operations and is therefore detrimental to efficiency.

The object on which the invention is based is to improve the process and apparatus of the type mentioned in the introduction, so that better (more economical) handling of the interlining blanks is obtained.

The apparatus according to the invention allows a work method (handling) in which the attendant grasps a prepared interlining blank and by pulling on this actuates an electrical switch which actuates a severing device (knife) electrically. The interlining blank can then be laid on the outer fabric and bonded to it in the way known from the older patent application No. P 34 05 505.3. At the same time as the attendant lays the interlining blank, the interlining dispenser continues to operate automatically by advancing the interlining blanks coming from a supply roll a preset fixed length immediately after the severing or cutting operation. The next interlining blank is thus ready to be extracted and the work cycle is ended.

Curves in the cut-off interlining blank (originating from the roll-shaped band material) can cause disturbances in the subsequent bonding process. Consequently, the interlining blank can be guided through a straightening device which straightens the material substantially flat during the advance.

The strip dispenser is provided with two unwinding spindles, so that, in the event of a sandwich bond, two strips can be cut off in each work cycle.

Because rolled-up interlining blanks are used, there is no need for the hitherto customary central production of interliring blanks from strip-shaped interlining material, thus also doing away with the special problem as regards stacking, bundling, storage and transport associated with this method of production. Now, without the interlining blanks needing to be divided off, the rolled-up strip-shaped interlining material is delivered directly to the bonding apparatuses, with the result that, in general terms, the efficiency of the bonding of textile sheet-like structures of varying size is improved considerably.

Because of the compact design of the apparatus, the interlining strips or interlining blanks can be produced locally on the bonding apparatus economically and with precision. In particular, in contrast to the central production of interlining blanks, the material only has to be handled once.

The invention is explained in more detail below with reference to an exemplary embodiment in conjunction with the drawing. In the drawing.

Figure 1:
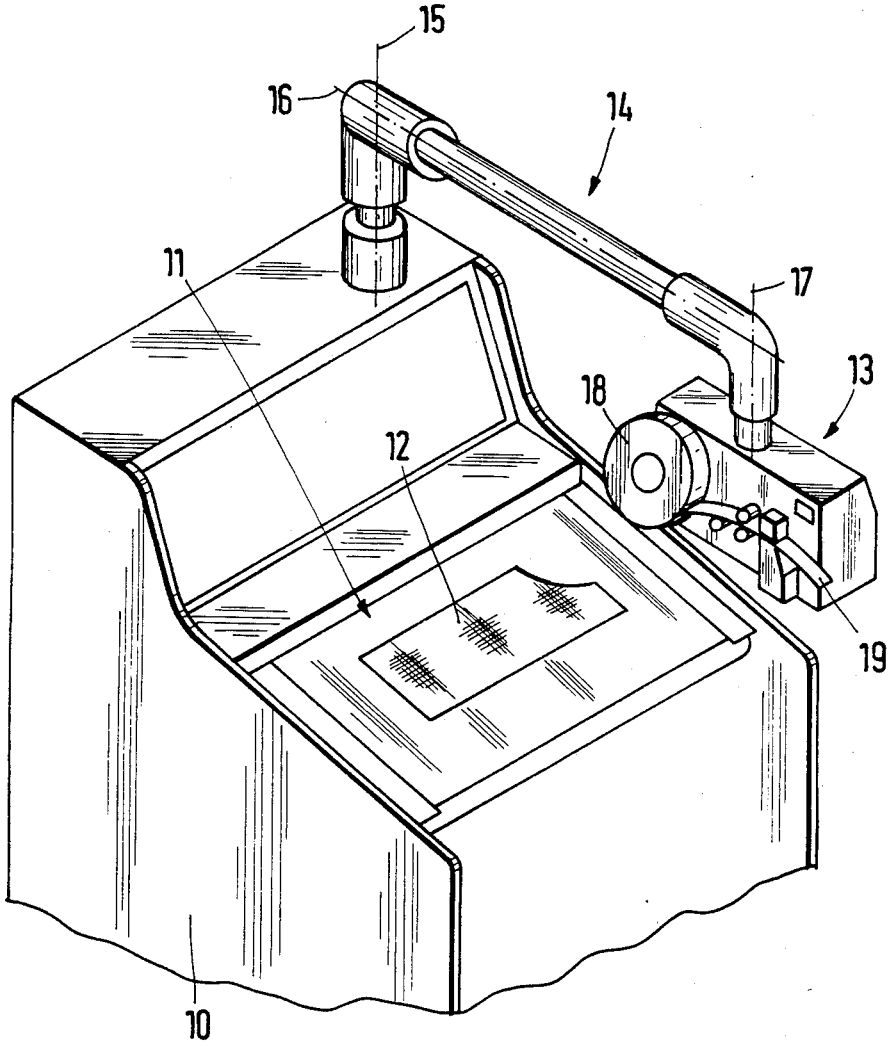
FIG. 1 shows a perspective representation of the feed station of an apparatus for bonding sheet-like textile articles (outer fabrics and interlining blanks) with an interlining dispenser.
Figures 2, 2A:
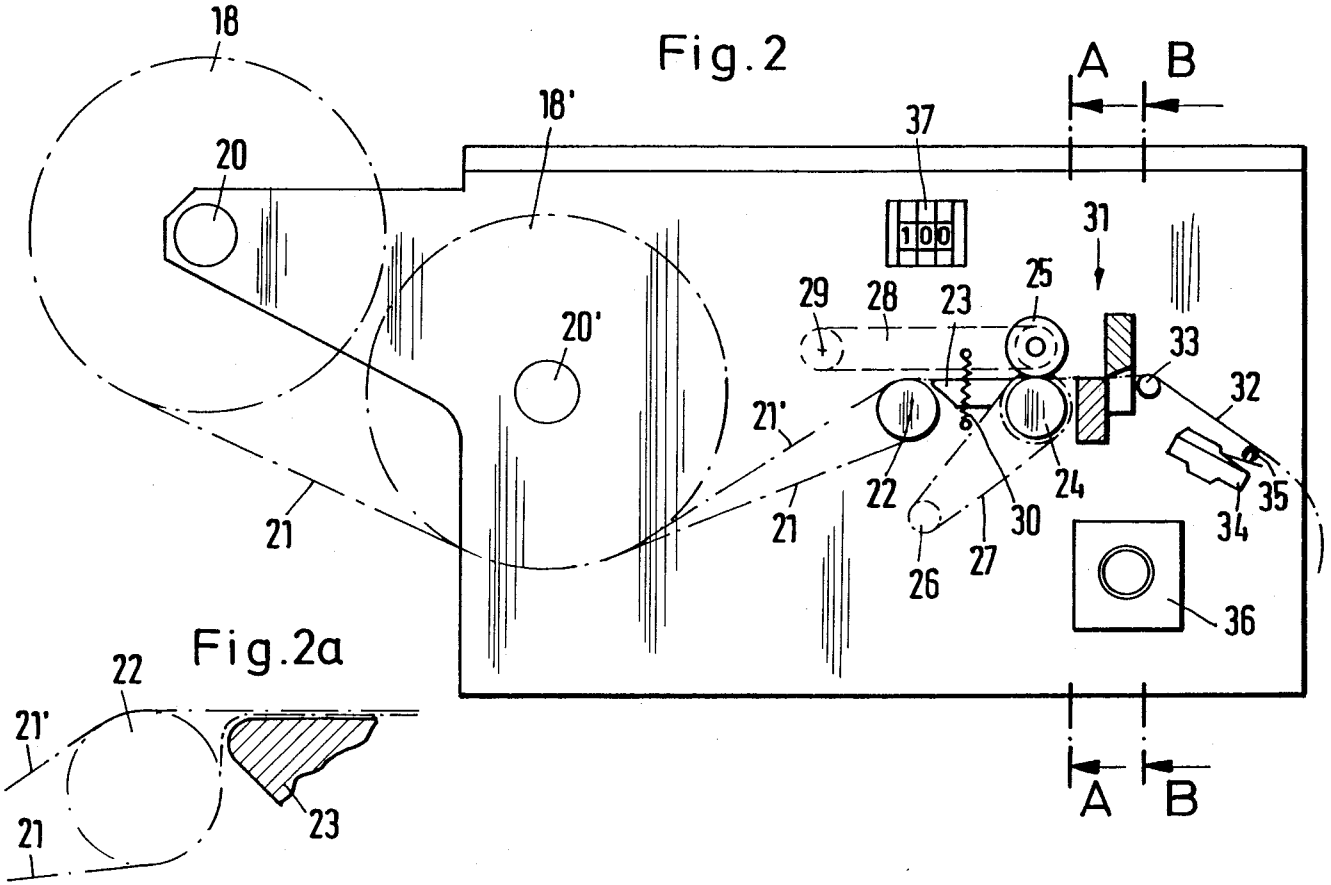
FIG. 2 shows a diagrammatic partially sectional view of the interlining dispenser of FIG. 1.
Figure 4:
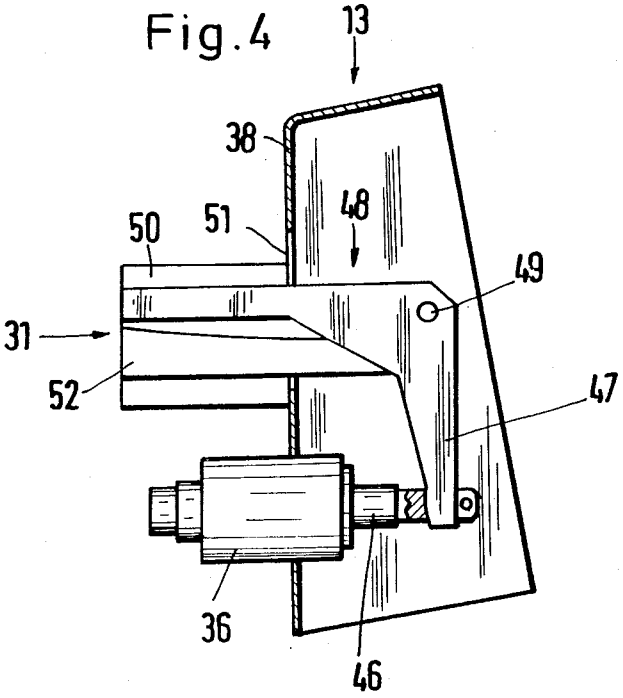
Figure 3:
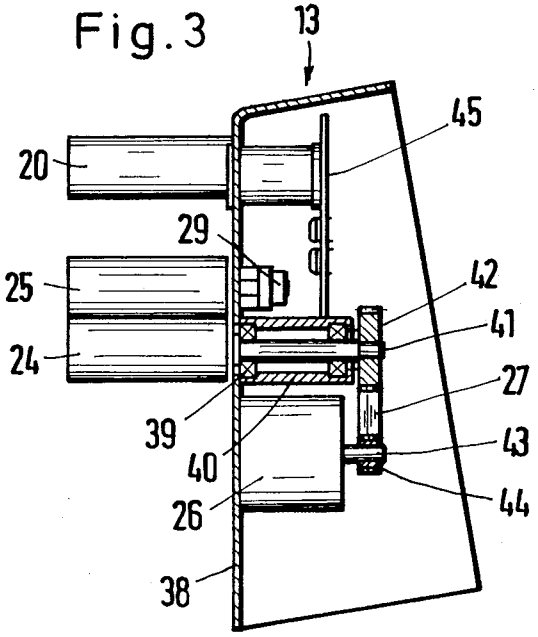
Figure 5:
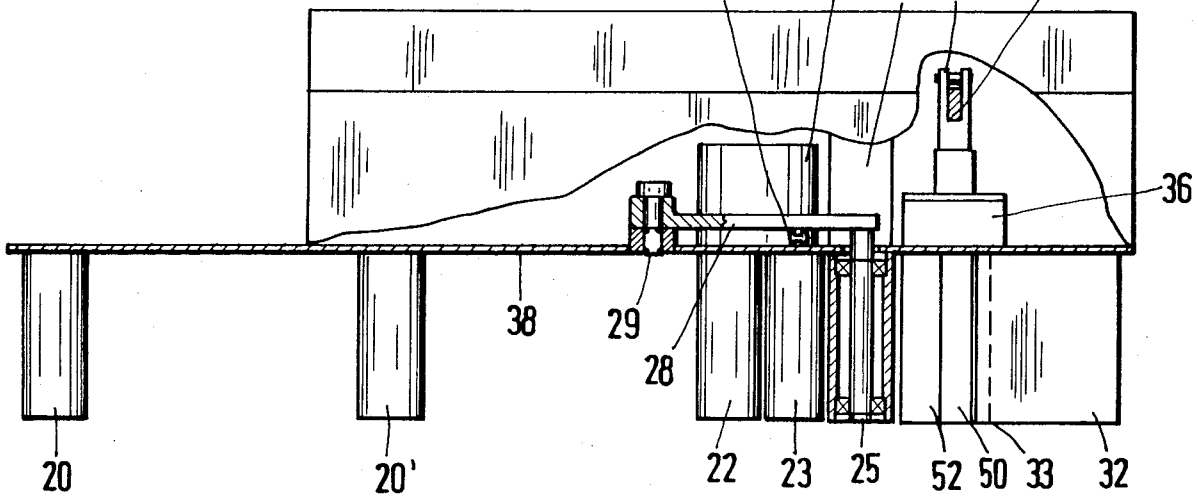
Figure 6:
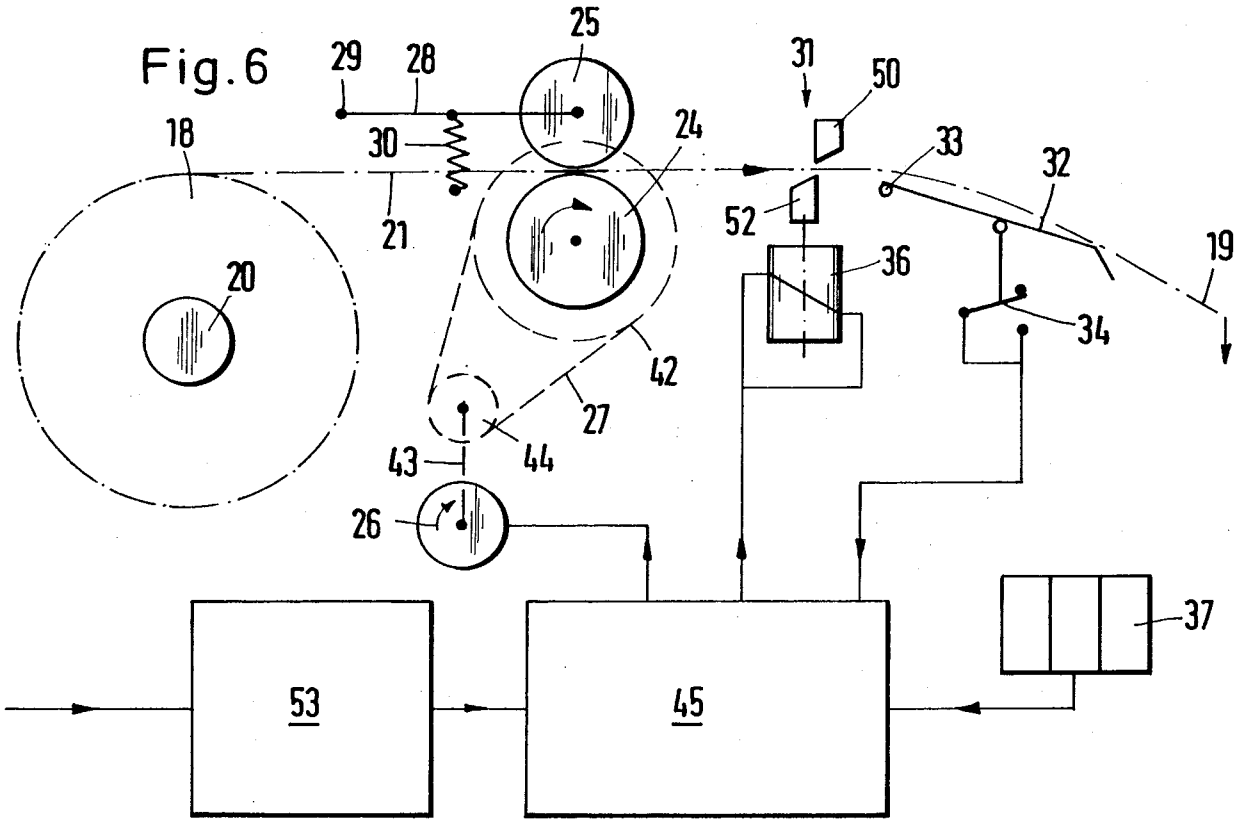
Figure 7:
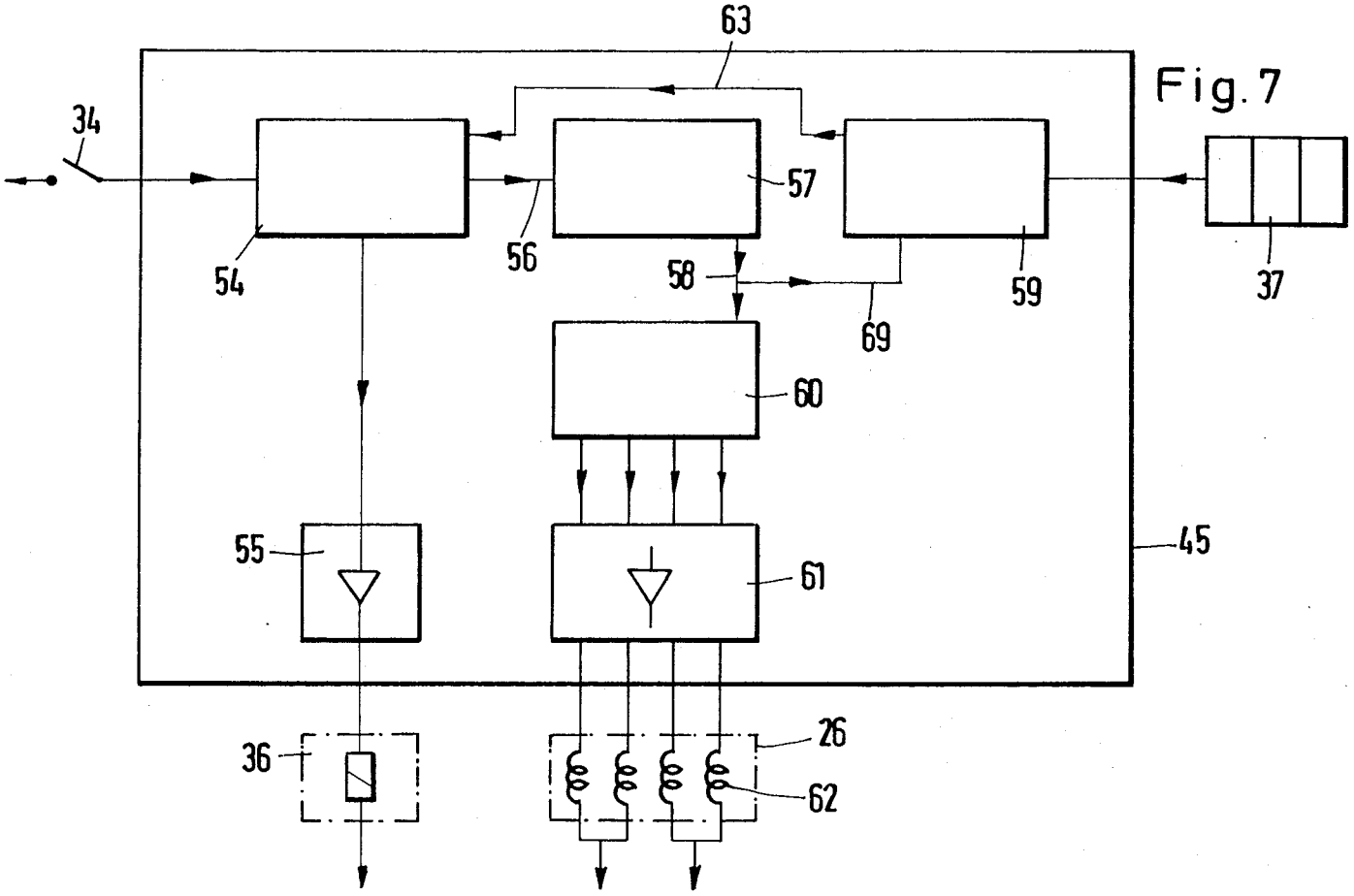
Figure 8:
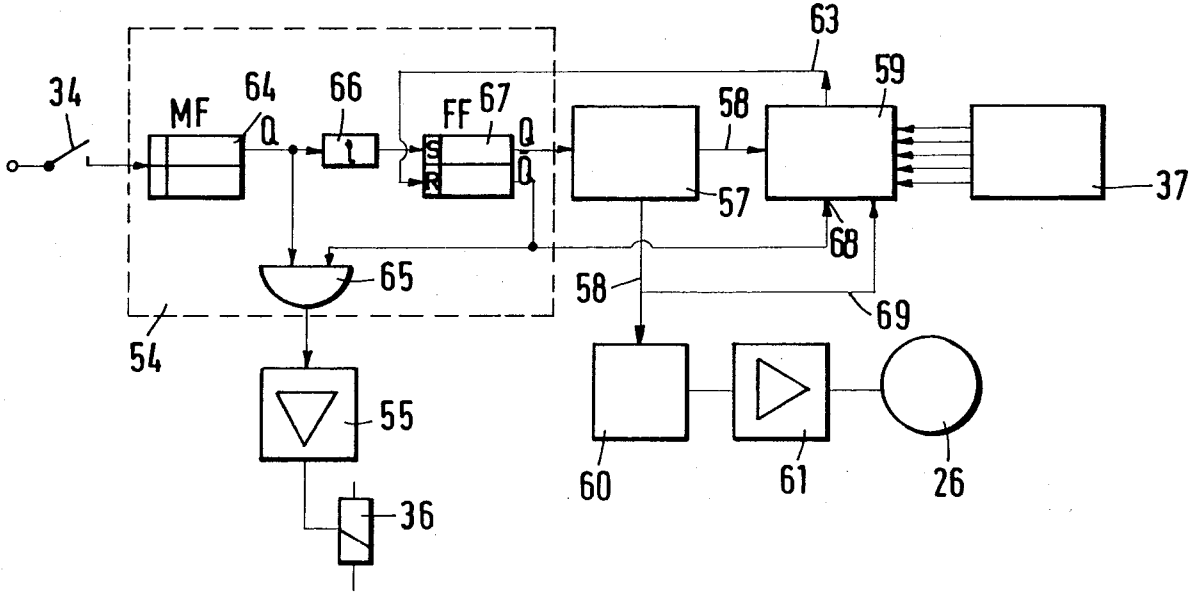

FIG. 2*a* shows a detail of the interlining dispenser according to FIG. 2, as a cutout on an enlarged scale;

FIG. 3 shows a section along the line A—A of FIG. 2;

FIG. 4 shows a section along the line B—B of FIG. 2;

FIG. 5 shows a plan view of the interlining dispenser of FIG. 1 in a partial sectional representation;

FIG. 6 shows a block diagram of the interlining dispenser;

FIG. 7 shows a block diagram of control electronics of the interlining dispenser; and, FIG. 8 shows a detailed block diagram of the electronics of FIG. 7.

The same reference symbols in the individual Figures denote identical parts or parts corresponding to one another.

The apparatus illustrated in FIG. 1 for bonding textile articles by means of heat and pressure is designated by the reference symbol 10. It has a feed station 11 with platens (not shown), and an outer-fabric part 12 has just been laid down here. An interlining dispenser 13 is arranged in the region of the feed station 11, specifically on a pivoting arm 14 fastened to the housing of the apparatus 10. This pivoting arm 14 is made approximately U-shaped and has altogether three pivot axes 15, 16 and 17, so that it can be moved into any positions in the region of the feed station 11. Thus, the two vertical pivot axes 15 and 17 are at right angles to the (horizontal) pivot axis 16.

A stock 18 of rolled-up interlining material is mounted in the form of a roll on the interlining dispenser 13, a front end of this interlining material projecting as a prepared interlining blank 19. This interlining blank 19 has a predetermined length and, as emerges from the following description, it is cut off in this length.

FIG. 2 shows a side view of the interlining dispenser 13. Two unwinding spindles 20 and 20' project perpendicularly from its front side, and on these supply rolls 18 and 18' with wound-on interlining material are mounted. Preferably, the interlining material has the form of a band 21 and 21' with straight edges. For specific uses, however, these edges can also have another contour in plan view, for example corrugated, zig-zag shaped, etc. Of course, when bonding is carried out only on one side, only one supply roll is used, whilst both the supply rolls 18 and 18' illustrated are required for the so-called "sandwich bonding", in which two units consisting of an outer fabric and an interlining are placed above one another in a mirror-inverted arrangement, in such a way that a first interlining is placed on a lower outer fabric and a further interlining together with an associated upper outer fabric is placed on this first interlining.

Band material 21 and 21′ coming from the supply rolls 18 and 18′ respectively passes over a deflecting roller 22 and from there arrives at a straightening device 23 with a plane, that is to say plate-shaped surface.

As can be seen from FIG. 2, the band material can be supplied to the top side of the straightening device 23 with a small looping angle around the deflecting roller 22, the radially uppermost line of the deflecting roller 22 lying essentially in one plane with the surface of the straightening device 23, so that the straightening device 23 is ineffective. The corresponding band guidance is shown in FIG. 2 for the band 21′. An alternative band guidance is shown for the band 21, this band being supplied essentially at right angles to the surface of the straightening device 23 and consequently being aligned with the surface of the straightening device 23 at the rounded edge.

From the straightening device 23, the band or the bands 21 and 21′ travel to a transport device which consists of a driven roller 24 and a non-driven pressure roller 25. The roller 24 is driven by a stepping motor 26 via a belt 27 (for example, a V-belt or a toothed belt). The pressure roller 25 is mounted on a pivoting arm 28, the other end of which is retained in a pivot bearing 29 fastened to the interlining dispenser 13, the pivoting arm 28 and consequently the pressure roller 25 being pressed against the roller 24 by a spring 30.

The band material 21 and/or 21′ passes from the nip between the rollers 24 and 25 to a severing device 31 and from there to a flap 32 directed obliquely downwards, of which the end pointing towards the severing device 31 is retained in a pivot bearing 33. Consequently, part of the front end of the band, in particular the interlining blank 19 (not yet cut off here), lies on the top side of the flap 32. Arranged underneath the flap 32 is an electrical switch 34, the switching arm 35 of which is spring-prestressed and presses against the underside of the flap 32.

When the interlining blank 19 is pulled by hand, the flap 32 is pivoted downwards somewhat and actuates the switch 34. This transmits a control signal to electronics (FIGS. 6 to 9), whereupon an electromagnet 36 activates the cutting device 31, so that the interlining blank 19 is cut off. Immediately after this cutting operation, the stepping motor 26 is activated by the electronics, and the roller 24 is thereby driven via the belt 27 and consequently transports the band or the bands 21 and/or 21′, specifically a fixed length predetermined by a preselector switch 37.

Details of the process flow control are explained with reference to FIGS. 6 to 8.

FIG. 3 shows a section along the line A-A of FIG. 2. In particular, it primarily illustrates the exact arrangement of the drive shaft and pressure shaft 24 and 25 and of the stepping motor 26. The roller 24 and the pressure roller 25 are mounted on a housing side wall 38 of the interlining dispenser 13, and the bearing 39 for the (drive) roller 24 is fastened in a bearing mounting 40 projecting perpendicularly from the housing side wall 38 into the interior of the housing. A shaft stub 41 projects from the rear end of this bearing mounting 40 and carries a belt pulley 42. Underneath the bearing mounting 40, the stepping motor 26 is fastened, for example screwed, to the housing side wall 38 so as to project inwards into the housing, its motor shaft 43 likewise carrying a belt pulley 44. The belt pulleys 42 and 44 are connected to one another in drive terms by means of the belt 27. To obtain as sensitive an advance movement of the band 21 as possible, the step-down ratio between the belt pulley 44 and the belt pulley 42 is relatively high.

The electronic control 45 is also accommodated inside the housing, although its exact position of installation can be anywhere in it.

FIG. 4 shows a section along the line B—B of FIG. 2, that is to say detailed view of the cutting device 31. The electromagnet 36 is designed as a pushpull magnet and is fastened in the housing side wall 38. Its magnet plunger 46 is connected to one arm 47 of an L-shaped knife 48 retained in a pivot bearing 49. The cutting edge 50 of the knife 48 projects from the housing through an orifice 51 in the housing side wall 38.

In the exemplary embodiment illustrated, a stationary counter-knife 52 is arranged underneath the cutting edge 50, and the band 21 to be cut off runs through between the cutting edge 50 and the counterknife 52. When the electromagnet 36 is excited, the magnet plunger 46 pivots the knife 48 in the anti-clockwise direction, so that the cutting edge 50 is moved towards the counter-knife 52 and executes the cutting operation.

FIG. 5 shows a plan view from above of the interlining dispenser 13. In addition to FIGS. 2 to 4, FIG. 5 also shows the exact arrangement of the pivoting arm 28 for the pressure roller 25, specifically inside the housing, and the mounting of the pressure roller 25. The other parts which can be seen in FIG. 5 have already been explained with reference to FIGS. 2 to 4, so that there is no need for any repetition.

FIG. 6 shows a block diagram of the apparatus according to the invention. The entire process is carried out from the electronic control 45. The control receives input signals from the electrical switch 34 and the preselector switch 37 and transmits output signals to the electromagnet 36 and the stepping motor 26. Current is supplied from a power-supply unit 53.

When the end of the interlining blank 19 not yet cut off is pulled, the flap 32 is pivoted downwards and actuates the electrical switch 34 which consequently transmits a "starting signal" to the control 45. After this starting signal has been received, the control 45 first activates the electromagnet 36, as a result of which the severing device 31 is activated and the cutting edge 50, interacting with the counter-knife 52, cuts off the band 21. The electromagnet 36 then returns into its position of rest, for example as a result of spring force, and the electronics now activate the stepping motor 26 by pulses, so that the band 21 is transported by the drive roller 24 in interaction with the pressure roller 25. The control 45 now generates a specific number of pulses, so that the band 21 is advanced a predetermined fixed length. This number of pulses is determined by the digital preselector switch 37. The user can thus predetermine the length of the interlining blanks 19 cut off. As soon as the band 21 has been advanced this predetermined length, the control 45 stops the stepping motor 26, and the interlining dispenser is prepared for a new work cycle.

FIG. 7 shows the electronic control 45 in more detail. This contains a knife-magnet logic unit 54, one control input of which is connected to the switch 34. One output of the knife-magnet logic unit 54 is connected to a driver circuit 55 for the electromagnet 36. A signal output (line 56) of the knife-magnet logic unit 54 is connected to a starting input of a step-pulse generator 57. As soon as a signal appears on the line 56, the step-pulse generator 57 starts to generate pulses of a predetermined adjustable frequency at its output (line 58). These pulses are sent simultaneously to a counter 59 and a stepping-motor controller 60. The stepping-motor controller 60 is connected on the output side to a driver circut 61 for the steppihg motor 26 or its coils 62. At each pulse from the step-pulse generator 57, the stepping motor 26 is rotated through a fixed step angle.

The counter 59 counts the pulses transmitted to it by the step-pulse generator 57. A value set by the digital preselector switch 37 is transmitted to a further input of the counter 59. As soon as the count of the counter 59 corresponds to this predetermined value, a stop signal appears at its output (line 63) and is sent to the knife-magnet logic unit 54. In response to this stop signal, this terminates the activity of the step-pulse generator 57 via the line 56 and cancels a block for the magnet 36 to be actuated. This ends a work cycle.

FIG. 8 shows a possible embodiment of the control 45 with conventional components.

The knife-magnet logic unit 54 contains a monostable flip-flop 64, the input of which is connected to the switch 34. The output Q of the monostable flip-flop 64 is connected to one input of an AND gate 65 and at the same time to an input of a time-delay element 66. The output of this time-delay element 66 is connected to the setting input S of a bistable flip-flop 67, the output Q of which is connected to the start/stop input of the step-pulse generator 57. The inverted output Q of the flip-flop 67 is connected to the other input of the AND gate 65. The output of the AND gate 65 is connected to the electromagnet 36 via the driver circuit 55. The output of the step-pulse generator 57 is connected on the one hand to the stepping motor 26 via the stepping-motor controller 60 and the driver circuit 61 and on the other hand to the counting input of the counter 59 via the line 69. Further inputs of the counter 59 are connected to the preselector switch 37. Here, the counter 59 is a down counter which, in response to a control pulse at its "preset" input 68 connected to the output of the flip-flop 67, assumes a count predetermined by the preselector switch 37 and, starting from this count, counts down one digit at each pulse from the step-pulse generator 57. As soon as the counter 59 has reached the count "zero", the stop signal appears at an output of the counter 59 (line 63) and is transmitted to the resetting input R of the flip-flop 67.

The mode of operation of this circuit is as follows:

When the switch 34 is actuated, the monostable flip-flop 64 is thereby activated and emits a single pulse at its output Q. It may be assumed that the bistable flip-flop 67 is in the state of rest, in which a positive signal (when the logic unit is positive) is present at its inverted output $\overline{Q}$. Consequently, the AND gate 65 becomes conductive as a result of the output signal from the monostable flip-flop 64, whereupon the electromagnet 36 is excited and moves the severing device 31 (cutting edge 50). Furthermore, the output signal from the monostable flip-flop 64 is delayed by the time-delay element 66 for a predetermined time corresponding to the actuation time of the knife 48, so that the bistable flip-flop 67 switches its output Q to a logical "one" only after this delay time has elapsed. The step-pulse generator 57 is activated as a result. When the flip-flop 67 becomes conductive, a logical "zero" appears at the output Q of the flip-flop 67, so that the AND gate 65 is blocked, thus ensuring that the (knife) magnet 36 cannot be excited as long as the step-pulse generator 57 is active, even when the switch 34 is actuated during this period of time.

The pulses generated by the step-pulse generator 57 drive the stepping motor 26 in the way described and at the same time are counted in the counter 59. As soon as the number of pulses predetermined by the preselector switch 37 has been counted in the counter 59, a signal appears at its output (line 63) and is transmitted to the resetting input R of the bistable flip-flop 67. The flip-flop 67 thus switches back into its state of rest, that is to say a logical "zero" appears at its output Q, whilst a logical "one" appears at its output $\overline{Q}$. The step-pulse generator 57 is consequently stopped and the AND gate 65 prepared to transmit the next output pulse from the monostable flip-flop 64 to actuate the (knife) magnet 36. At the same time, the connection between the output $\overline{Q}$ of the flip-flop 67 and the "preset" input 68 of the counter 59 ensures that the counter 59 resumes the "count" predetermined by the preselector switch 37. A new work cycle can now begin.

All the technical details represented in the patent claims, the description and the drawing can be essential to the invention either in themselves or in any combination with one another.

I claim:

1. In an apparatus for bonding sheet-like textile articles, especially those for outer clothing, comprising:

means including platens movable relative to one another for bonding textile articles, interlining material and outer fabric, to one another under heat and pressure, a feed station at which the textile articles to be bonded together are manually laid on one another, said feed station being disposed on the operator's side of the apparatus, and a holder for a stock of interlining material and disposed in the region of the feed station, the improvement comprising:

interlining dispenser means (13) for supporting rolled-up, essentially strip-shaped interlining material (21, 19) and for cutting said interlining material to a fixed dimension.

2. Apparatus according to characterised by a band-straightening device (23) which can be activated or inactivated selectively (via a deflecting roller 22).

3. Apparatus according to claim 2, characterised in that the band-straightening device (23) has a plate-shaped surface and a rounded portion on the inlet side, a preceding deflecting roller (22) being arranged in such a way that its top side is in one plane with the top side of the straightening device (23), and its front side is so arranged relative to the rounded edge that the band (21, 21') can be supplied at an angle of approximately 90° relative to the top side of the straightening device (23).

4. Apparatus according to claim 1, characterised in that the interlining dispenser means (13) is arranged in the region of the feed station (11) on a pivoting arm (14) movable in the region of the latter.

5. Apparatus according to claim 4, characterised in that the interlining dispenser means (13) is mounted rotatably on the pivoting arm (14).

6. Apparatus according to claim 4, characterised in that the pivoting arm (14) has at least two pivot axes (15, 16) which are at right angles to one another.

7. Apparatus according to claim 1, characterised in that the interlining dispenser means (13) has at least one supply roll (18, 18') for the rolled-up strip-shaped interlining material (bands 21, 21').

8. Apparatus according to claim 7, characterised in that the interlining dispenser means (13) has two supply rolls (18, 18'), and the bands (21, 21') unwound from these are, after an unwinding zone, guided parallel to and in contact with one another.

9. Apparatus according to claim 1, characterised in that arranged in the region of the outlet end of the interlining dispenser means (13) is a pivotable flap (32), on the top side of which rests one end (interlining blank 19) of the band (21, 21') and the underside of which is supported on a spring-prestressed switching arm (35) of an electrical switch (34).

10. Apparatus according to claim 9, characterised in that a severing device (31) (knife 48 and counter-knife 52) is arranged in front of the flap (32) in the direction of transport of the band (21, 21'), and in that this severing device (31) can be actuated by an electromagnet (36) which can be activated as a result of the actuation of the electrical switch (34).

11. Apparatus according to claim 1, characterised by a transport device (stepping motor 26, belt 27, drive roller 24 and pressure roller 25) and by an electronic control (45) which, after the cutting operation has ended, actuates the stepping motor (26) for a number of pulses which can be preset (preselector switch 37).

12. Apparatus according to claim 10 or 11, characterised in that the electronic control (45) contains the following: a knife-magnet logic unit (54) which can be activated via the switch (34) and which on the one hand activates the electromagnet (36) and on the other hand starts and stops a step-pulse generator (57), the step-pulse generator (57) generating pulses of presettable frequency, which are supplied on the one hand to the stepping motor (26) and on the other hand to a counter (59) which, after reaching a number set by the preselector switch (37), generates a stop pulse which releases the knife-magnet logic unit (54) for a new excitation of the electromagnet (36) and which at the same time stops the step-pulse generator (57).

13. Apparatus according to claim 12, characterised in that the counter (59) is reset after counting a number of pulses which corresponds to the count predetermined by the preselector switch (37).

14. Apparatus according to claim 13, characterised in that the counter (59) is a down counter which, from a count predetermined by the preselector switch (37), counts down the pulses generated by the step-pulse generator (57) and at the count of zero generates a stop signal for the step-pulse generator (57).

15. Apparatus according to claim 12, characterised in that the output (to the electromagnet 36) of the knife-magnet logic unit (54) is blocked as long as the step-pulse generator (57) activates the stepping motor (26).

16. Apparatus according to claim 12, characterised in that there is a time-delay element (66) which, after the switch (34) has been actuated, delays the start of the step-pulse generator (57) for a predetermined period of time, this period of time corresponding to the actuation time of the severing device (31).

* * * * *